US008272328B1

(12) United States Patent
Gorman

(10) Patent No.: US 8,272,328 B1
(45) Date of Patent: Sep. 25, 2012

(54) METHOD OF CONVERTING BOMBLET TO HAND GRENADE

(75) Inventor: Ryan Gorman, Mountain Lakes, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 107 days.

(21) Appl. No.: 12/966,095

(22) Filed: Dec. 13, 2010

(51) Int. Cl.
*F42B 27/00* (2006.01)

(52) U.S. Cl. ..... 102/482; 102/486; 86/51; 86/56

(58) Field of Classification Search ..... 102/200, 102/476, 482–488; 86/51, 56
See application file for complete search history.

(56) References Cited

U.S. PATENT DOCUMENTS 4,852,496 A * 8/1989 Campagnuolo et al. ..... 102/322
7,490,555 B2 * 2/2009 Veksler ..... 102/393

FOREIGN PATENT DOCUMENTS

DE 1728489 B * 10/1975
FR 2020467 A * 7/1970

* cited by examiner

*Primary Examiner* — James Bergin
(74) *Attorney, Agent, or Firm* — Michael C. Sachs

(57) ABSTRACT

A method of converting a bomblet into a hand-thrown grenade may include providing a bomblet having a fuze, a shaped-charge liner, a casing, and explosive material disposed between the shaped-charge liner and the casing. The fuze may be removed from the bomblet. A housing may be attached a fuze end of the bomblet. The housing may adjoin the casing. A cavity that abuts and is exterior to the shaped-charge liner may be filled with a filler material, such as pellets. A hand-grenade fuze may be attached to the fuze end of the bomblet.

13 Claims, 7 Drawing Sheets

2B
46
48
34
44
18
16
50
60
26
24
20
2C

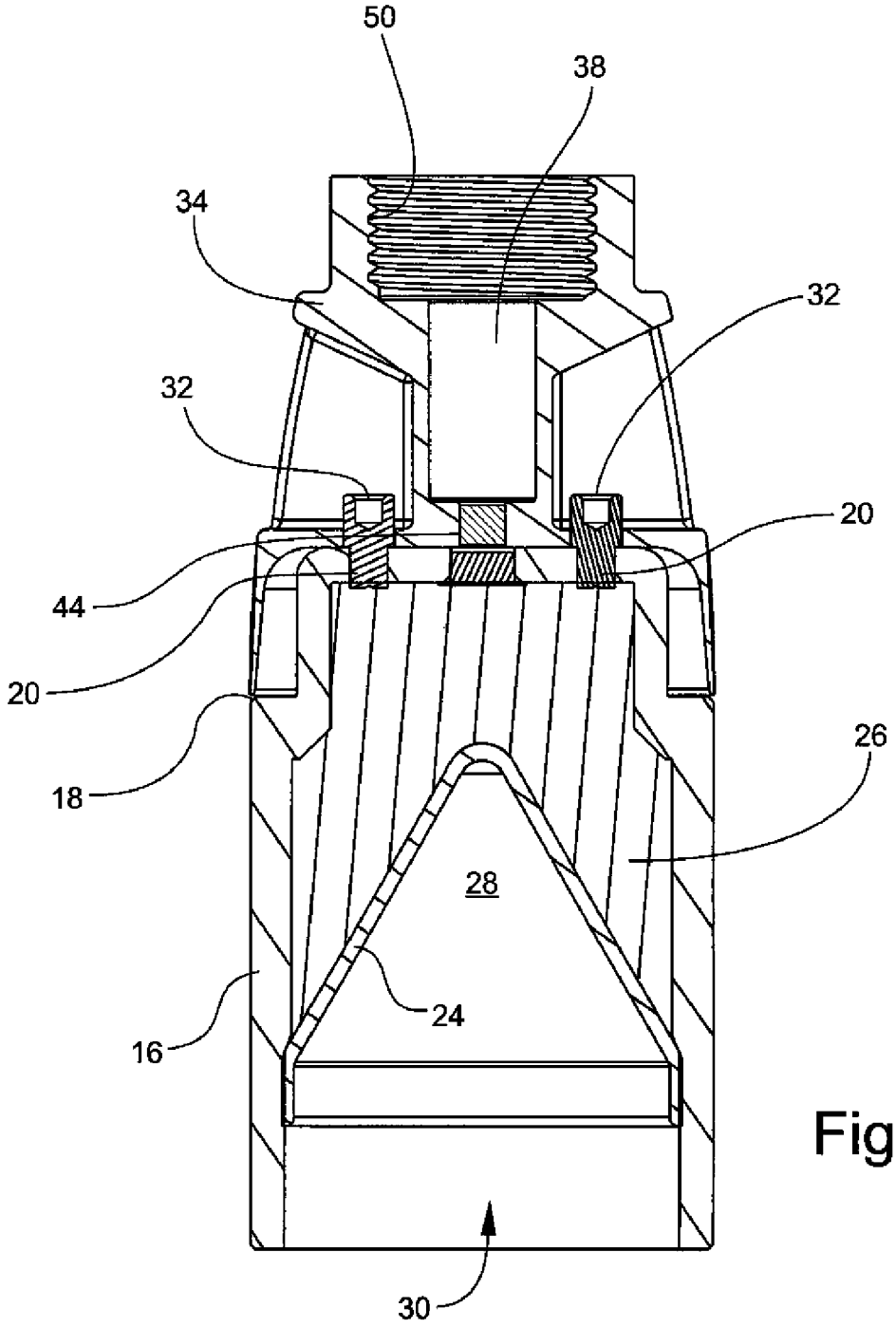
Fig. 4B
Fig. 5
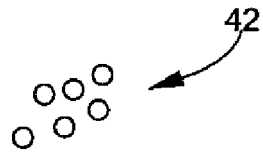

METHOD OF CONVERTING BOMBLET TO HAND GRENADE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to hand-thrown grenades.

Some large gun-launched projectiles, such as 155 mm projectiles, may carry many submunitions or bomblets that may be expelled in flight. Each bomblet may be independently stablized and armed. One type of bomblet may include a point detonating fuze that detonates the bomblet on impact. Detonation of the bomblet may send anti-personnel fragments radially and may send a shaped-charge jet downward. A large number of gun-launched projectiles that contain bomblets may no longer be used. Thus, there may be millions of surplus bomblets.

If the surplus bomblets are destroyed, the large original capital investment in the bomblets will be lost. And, the process of de-militarizing the bomblets is another large cost. A need exists for a cost-effective method of converting surplus bomblets into useful products.

SUMMARY OF THE INVENTION

It is an object of the invention to provide a cost-effective method for converting surplus bomblets into useful products.

One aspect of the invention is a method of converting a bomblet into a hand-thrown grenade. The bomblet may included a fuze, a shaped-charge liner, a casing, and explosive material disposed between the shaped-charge liner and the casing. The method may include removing the fuze from the bomblet and attaching a housing to a fuze end of the bomblet. The housing may adjoin the casing. A cavity that abuts and is exterior to the shaped-charge liner may be filled with a filler material. A hand-grenade fuze may be attached to the fuze end of the bomblet.

The bomblet may include studs that were used to stake the bomblet fuze to the bomblet. The housing may include openings therein for receiving the studs. The housing may be attached by re-staking the studs to fix the housing in place. The housing may abut the shoulder of the casing. The housing may have a central opening therein. One end of the central opening may include internal threads.

The method may include placing a stab detonator in the central opening in the housing. The hand-grenade fuze may be inserted in the central opening in the housing.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 4B is a sectional view of FIG. 4A along a plane through the studs.

FIG. 5 shows pellets.

DETAILED DESCRIPTION OF THE PREFERRED EMBODIMENTS

A known Dual Purpose Improved Conventional Munition (DPICM) bomblet may be converted into a hand grenade that may be thrown by soldiers. The process of converting the known DPICM bomblet into a hand grenade may be about 30 to 40% cheaper than purchasing a new hand grenade.

Figure 1A:
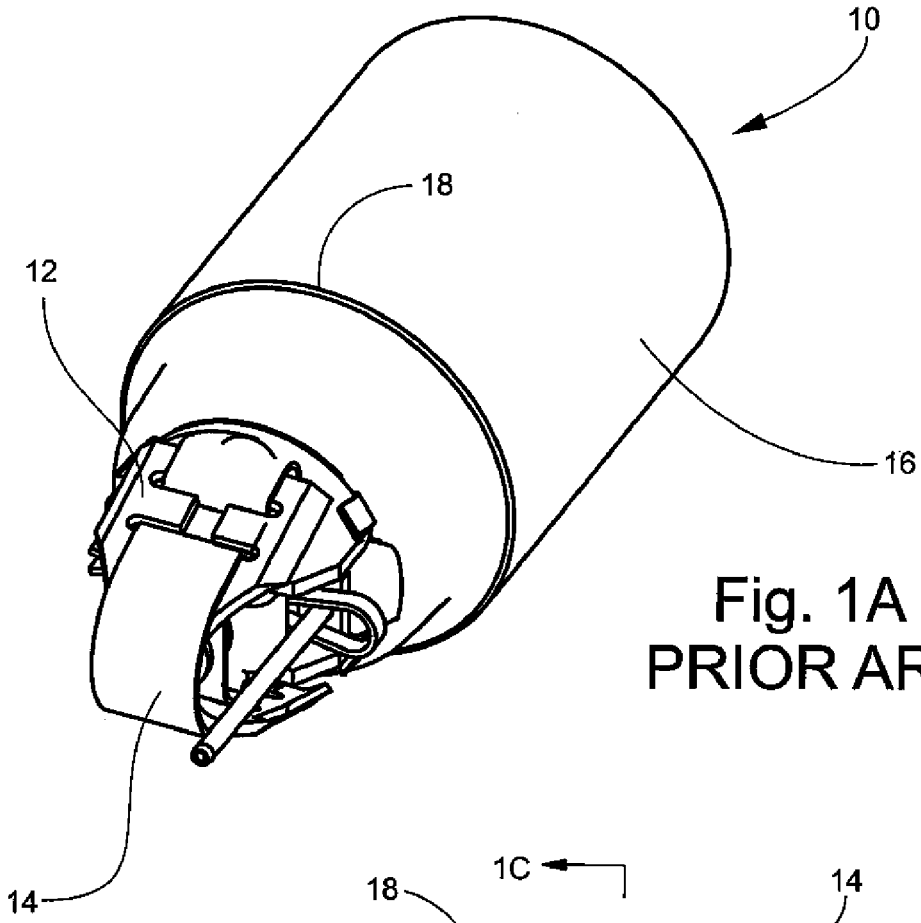
Fig. 1A PRIOR ART
FIG. 1A is a perspective view of a bomblet.
Figure 1B:
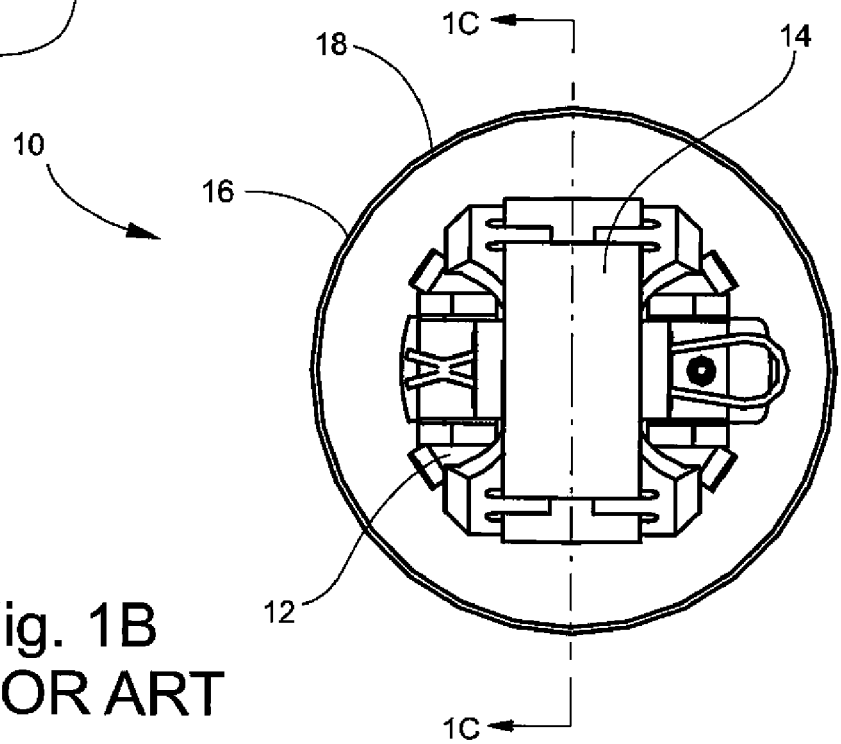
Fig. 1B PRIOR ART
FIG. 1B is a top view of the bomblet of FIG. 1A.
Figure 1C:
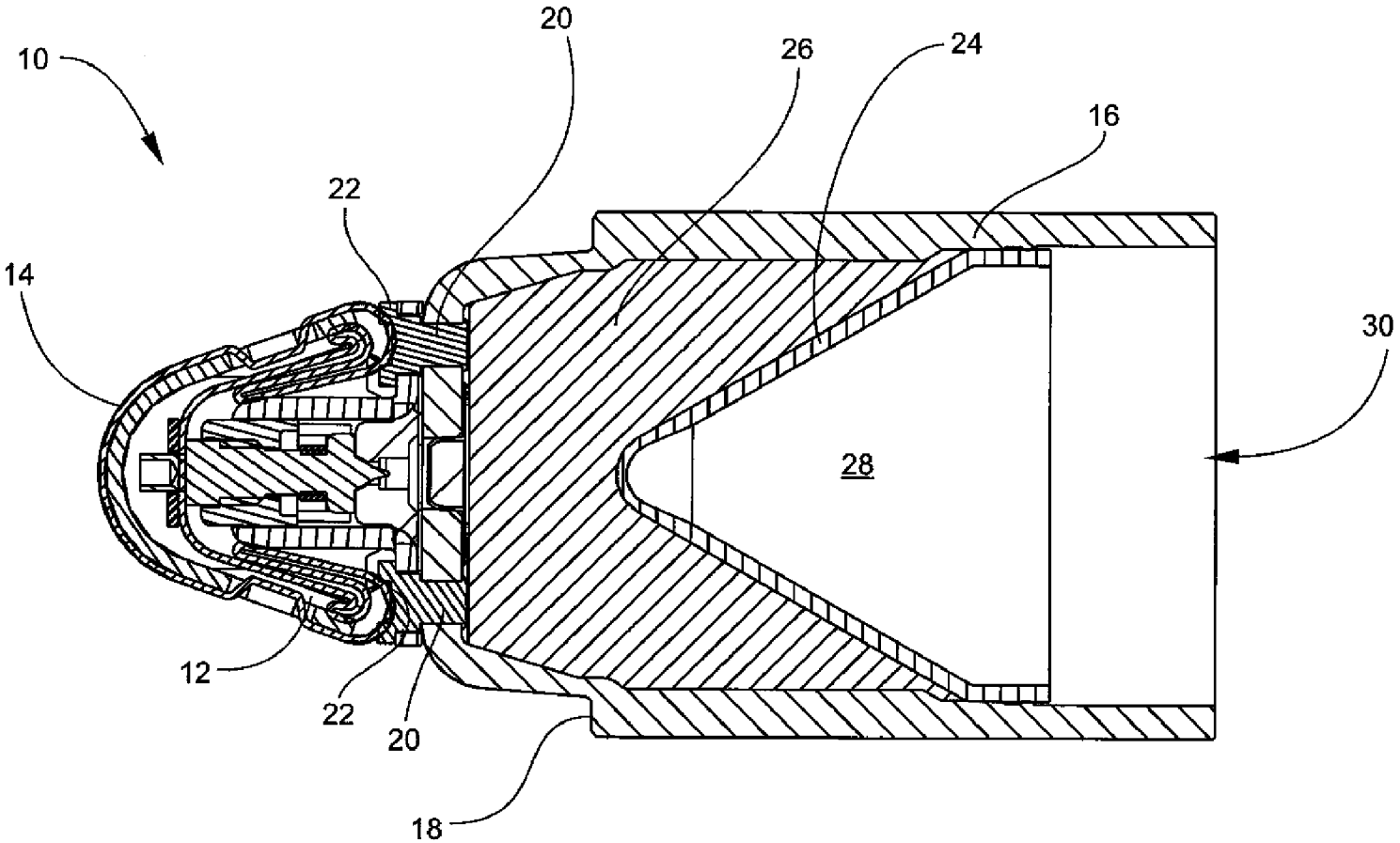
Fig. 1C PRIOR ART
FIG. 1C is a sectional view taken along the line 1C-1C of FIG. 1B.

FIGS. 1A-C show an embodiment of a known DPICM bomblet 10. Bomblet 10 may include a fuze 12 staked thereon. Fuze 12 may be, for example, an M223 fuze. Studs 20 may be used to stake fuze 12 to bomblet 10. Fuze 12 may include a ribbon stabilizer 14. Bomblet 10 may include a steel casing 16 having an external shoulder 18. Explosive material 26 may be disposed between casing 16 and a shaped-charge liner 24. The exterior surface of liner 24 may define a cavity 28 with an open end 30.

Figure 2A:
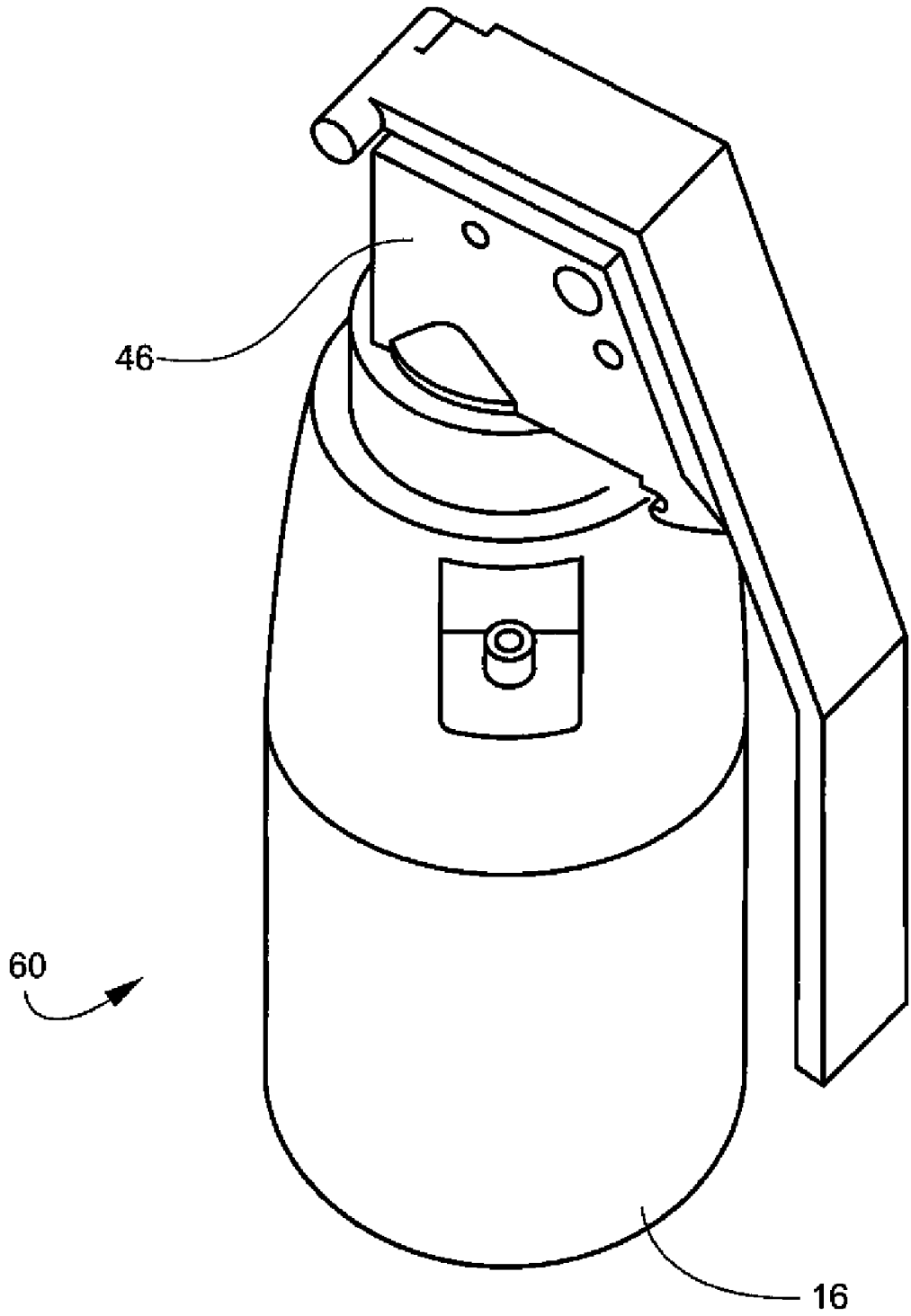
FIG. 2A is a perspective view of a hand-thrown grenade constructed in accordance with the invention.
Figures 2B, 2C:
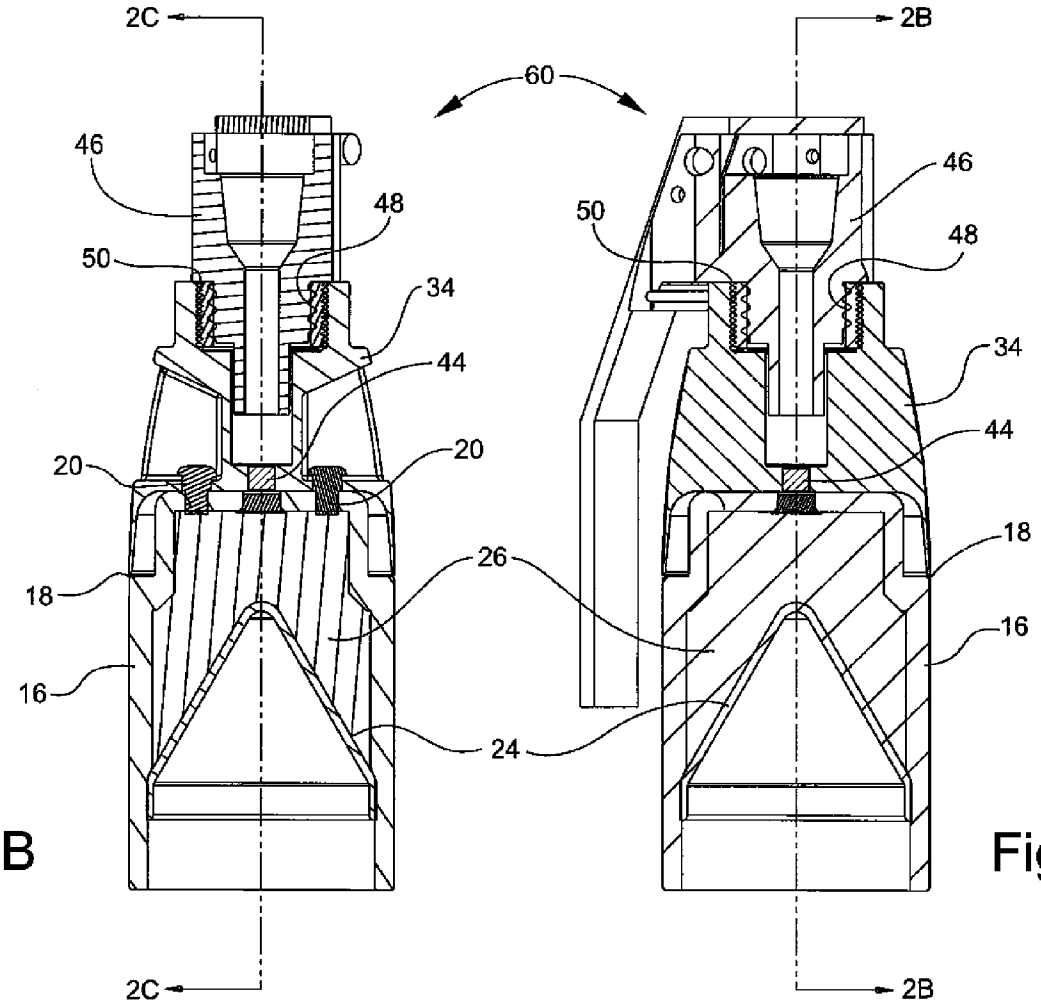
FIG. 2B is a sectional view of the grenade of FIG. 2A, taken along the line 2B-2B of FIG. 2C.
FIG. 2C is a sectional view taken along the line 2C-2C of FIG. 2B.
Figure 4A:
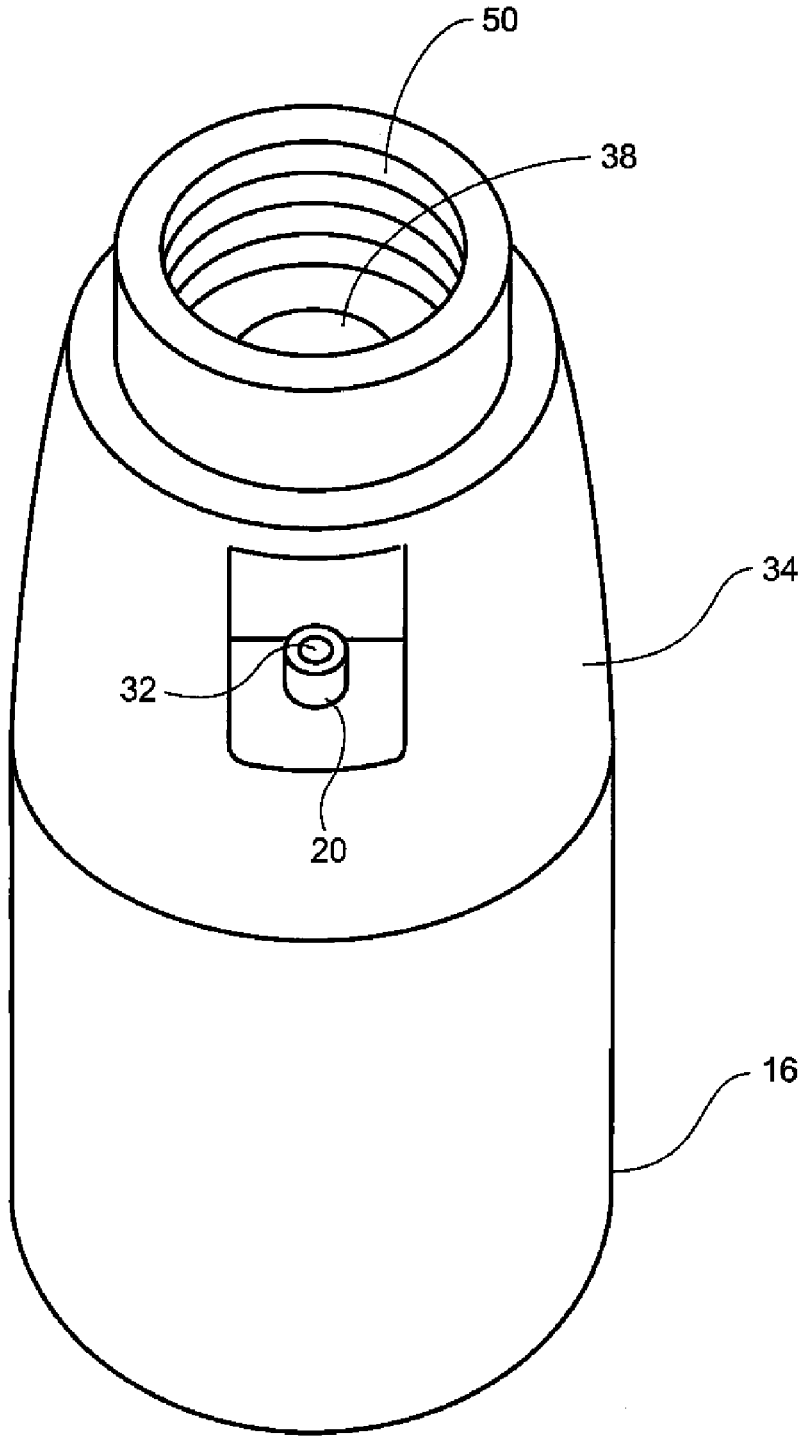
FIG. 4A is a perspective view of an intermediate step in converting a bomblet to a hand-thrown grenade.

FIGS. 2A-C show an embodiment of a hand-thrown grenade 60 constructed by converting bomblet 10. A method of converting bomblet 10 may include removing fuze 12 (FIGS. 1A-C) from bomblet 10. Fuze 12 may be removed from bomblet 10 by, for example, milling staked material 22 and lifting fuze 12 from bomblet 10. Then, the ends of the shortened studs 20 may be drilled to form interior holes 32 (FIG. 4B).

Figures 3A, 3B, 3C:
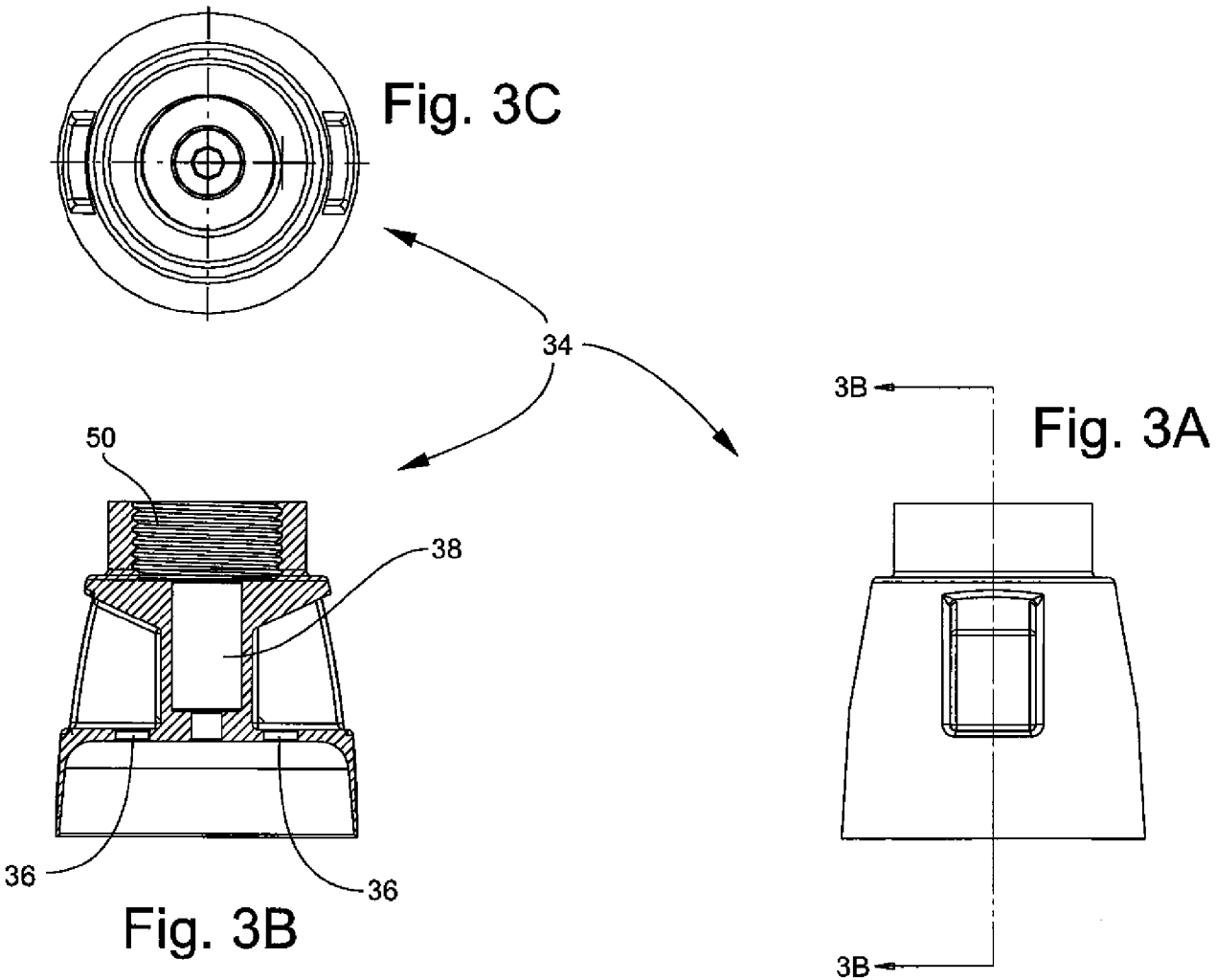
FIG. 3A is a side view of an embodiment of a grenade housing.
FIG. 3B is a sectional view along the line 3B-3B of FIG. 3A.
FIG. 3C is a top view of the grenade housing of FIG. 3A.

A housing 34 (FIGS. 3A-C) may be attached to the fuze end of bomblet 10. Housing 34 may adjoin casing 16 and may abut shoulder 18 of casing 16. Housing 34 may include openings 36 formed therein for receiving studs 20. Housing 34 may include a central opening 38 formed therein. Opening 38 may include internal threads 50 at one end. Housing 34 may be made of, for example, plastic, metal, or epoxy. Housing 34 may be fixed in placed on casing 16 (FIGS. 4A-B) by inserting studs 20 in openings 36 in housing 34 and resting the bottom of housing 34 on shoulder 18. Interior holes 32 in studs 20 may be used to stake studs 20 and secure housing 34 in place.

The method may include filling cavity 28 (FIG. 4B) with a filler material. Filler material may include pellets 42 (FIG. 5), such as steel buckshot. Pellets 42 may impart increased lethality to hand-grenade 60. Pellets 42 may be held in a matrix, such as a polymer matrix, that may be fixed to the exterior surface of liner 24 using, for example, an adhesive. Filler material may also include, for example, sand, epoxy, or plastic or other suitable materials.

A stab detonator 44 (FIG. 4B) may be placed in central opening 38 in housing 34. Stab detonator 44 may be, for example, an M55 stab detonator. As shown in FIGS. 2A-C, a hand-grenade fuze 46 may then be inserted in central opening 38 in housing 34. Fuze 46 may include external threads 48 for engaging internal threads 50 formed in one end of central opening 38. Fuze 46 may be, for example, an M218 hand-grenade fuze.

The novel method uses a bomblet designed for use in artillery projectiles and converts the bomblet into a hand-thrown grenade for the infantry. The method may save the cost of demilitarizing millions of bomblets and the cost of procuring new hand grenade warheads. In addition, the method may recover sunken costs in existing hardware.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A method of converting a bomblet into a hand-thrown grenade, comprising:

providing the bomblet, the bomblet including a fuze, a shaped-charge liner, a casing, and explosive material disposed between the shaped-charge liner and the casing;

removing the fuze from the bomblet;

attaching a housing to a fuze end of the bomblet, the housing adjoining the casing;

filling a cavity that abuts and is exterior to the shaped-charge liner with a filler material; and installing a hand-grenade fuze to the fuze end of the bomblet.

2. The method of claim 1, wherein providing the bomblet includes providing the bomblet with studs used to stake the bomblet fuze to the bomblet and wherein attaching the housing includes attaching the housing with openings therein for receiving the studs.

3. The method of claim 1, wherein removing the fuze includes removing an M223 fuze.

4. The method of claim 2, wherein attaching the housing includes re-staking the studs to fix the housing in place.

5. The method of claim 4, wherein attaching the housing includes abutting the housing against a shoulder of the casing.

6. The method of claim 4, wherein the filler material comprises pellets.

7. The method of claim 5, wherein attaching the housing includes attaching the housing having a central opening therein, one end of the central opening including internal threads.

8. The method of claim 7, further comprising placing a stab detonator in the central opening in the housing.

9. The method of claim 8, wherein placing the stab detonator includes placing an M55 stab detonator.

10. The method of claim 8, wherein installing the hand-grenade fuze includes inserting the hand-grenade fuze in the central opening in the housing and engaging external threads of the hand-grenade fuze with the internal threads of the one end of the central opening.

11. The method of claim 10, wherein installing the hand-grenade fuze includes installing an M218 hand-grenade fuze.

12. The method of claim 4, wherein removing the fuze includes milling staked material from the studs.

13. The method of claim 12, wherein attaching the housing include forming holes in ends of the studs to enable re-staking the studs.

* * * * *